United States Patent [19]

Kessler

[11] 4,314,656

[45] Feb. 9, 1982

[54] CHILDPROOF PUSH-PULL CONTAINER CLOSURE

[76] Inventor: Milton Kessler, 6690 Harrington Ave., Youngstown, Ohio 44512

[21] Appl. No.: 90,467

[22] Filed: Nov. 1, 1979

[51] Int. Cl.[3] ..... B67D 5/32

[52] U.S. Cl. ..... 222/153; 222/525

[58] Field of Search ..... 222/499, 525, 153; 215/216

[56] References Cited

U.S. PATENT DOCUMENTS

| | | | |
|---|---|---|---|
| 2,998,902 | 9/1961 | Thomas et al. | 222/525 X |
| 3,297,212 | 1/1967 | Neuner | 222/525 X |
| 3,426,949 | 2/1969 | James | 222/499 |
| 3,964,634 | 6/1976 | Jasinski et al. | 222/153 X |

*Primary Examiner*—Stanley H. Tollberg
*Attorney, Agent, or Firm*—Burge & Porter Co.

[57] ABSTRACT

A childproof, push-pull container closure includes a body portion having an opening through which container contents may be discharged. A cap is secured to the body portion and is adapted for movement axially of the body portion. The cap is mounted to the body portion by means of a formation extending from the upper surface of the body portion. In one embodiment, the formation defines recesses spaced 180° from each other and located near the periphery of the body portion. The cap includes a top wall having a depending skirt along the lower edge of which an annular, radially inwardly directed flange is included. When the cap is in a closed position, the recesses and the annular flange are engaged in interlocking relationship. In order to unlock the cap, the skirt is distorted by applying force to the skirt at appropriate opposed circumferential locations until the annular flange is moved from the recesses. Certain embodiments of the invention include an upstanding portion projecting from the midpoint of the ledge; an inner skirt depends from the top wall and snugly engages the upstanding portion. This construction permits movement of the cap to be constrained. In all embodiments of the invention, the cap includes a seal engageable with a sealing surface included as part of the body portion.

18 Claims, 17 Drawing Figures

10

100

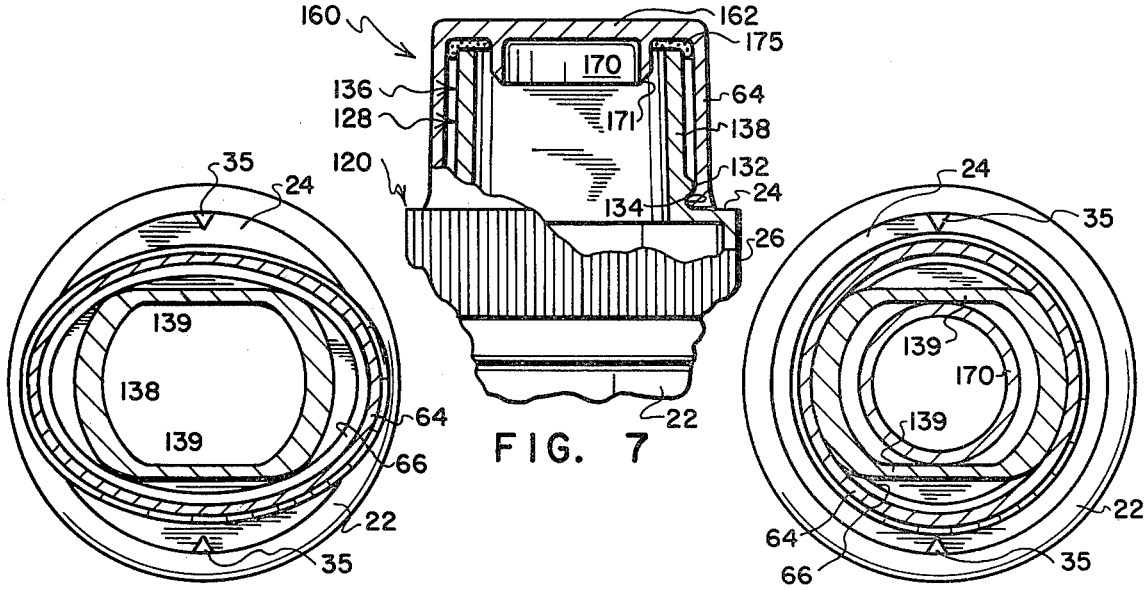
FIG. 7
FIG. 9
FIG. 8
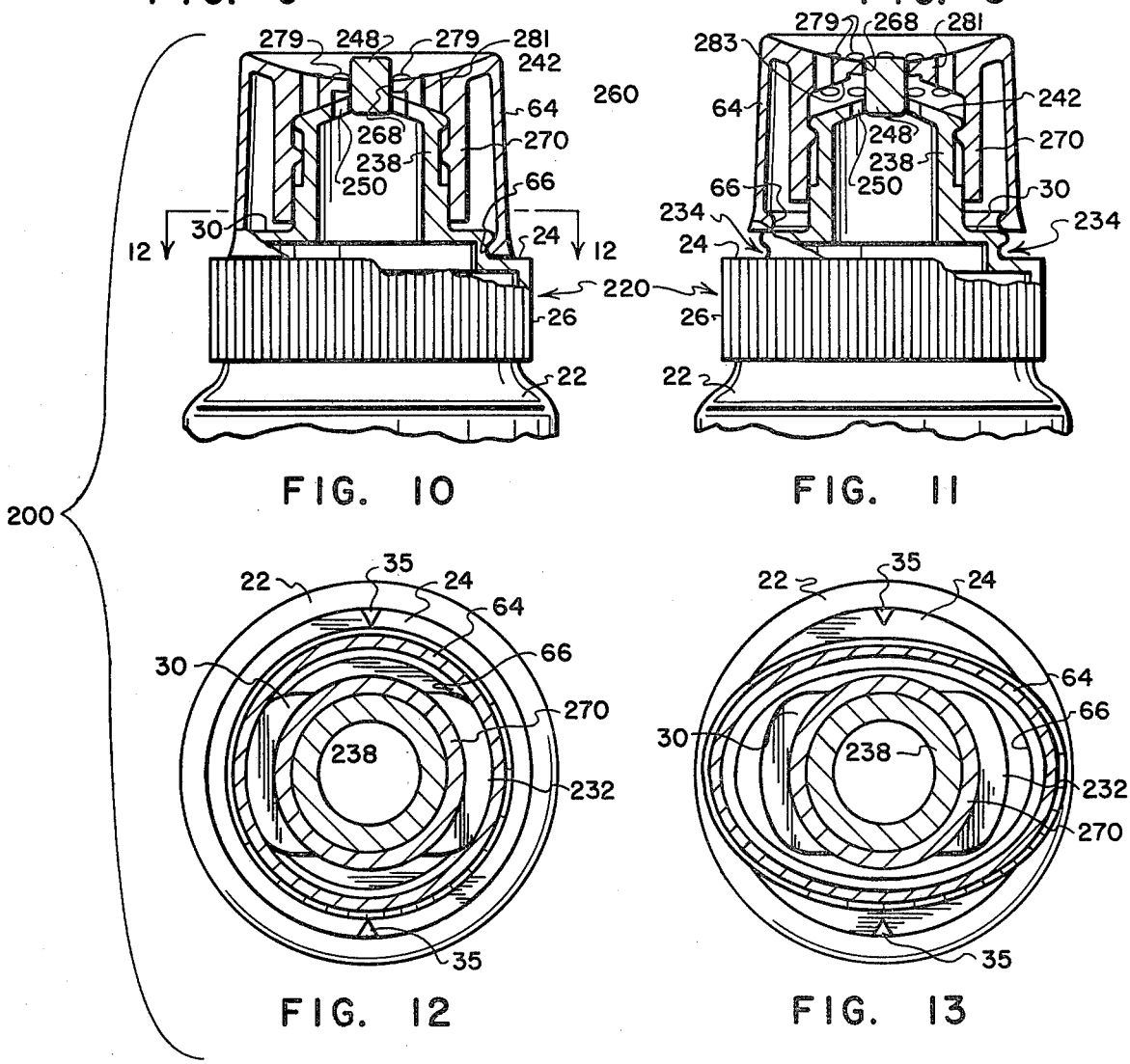
FIG. 10
FIG. 11
FIG. 12
FIG. 13

362
383
381
379
342
370
360
373
338
30
340
24
16
16
320
26
300
35
24
22
64
66
338
30
370
35

379
362
342
383
370
381
373
30
340
32
32
34
34
26

35
24
22
338
30
64
370
66
35

CHILDPROOF PUSH-PULL CONTAINER CLOSURE

BACKGROUND OF THE INVENTION

1. Field of the Invention

The present invention relates to childproof container closures for packaging liquids, powders, pills, and the like and, more particularly, to a childproof container closure in which a cap must be deliberately acted upon through the use of forces or movements greater or more complex than that of which a child is capable of accomplishing in order to permit the cap to be moved to a container-open position.

2. Description of the Prior Art

Numerous versions of childproof container closures are known, the object of all of which is to prevent a child from having access to the container contents. Generally speaking, these prior container closures require a deliberate manipulation of the closure in order to have access to the container contents. For example, typical container closures require that a cap be distorted or acted upon by force applied in some pre-determined manner or direction in order to release a locking device, and removal of the cap thereafter is permitted upon the application of force in a different direction.

One known class of container closures requires that an outer portion of the cap be squeezed in order to flex the outer portion and thereby disengage interlocking, concealed components. Thereafter, provided the cap is continued to be squeezed for at least a certain period of time, the cap can be rotated with respect to the container and unscrewed from a threaded dispensing end of the container. In another class of container closures, the cap includes an inner, cylindrical skirt and an outer, cylindrical skirt. The inner and outer skirts are connected to each other. By squeezing the outer skirt at indicated locations, the inner skirt is distorted and interlocking components carried by the inner skirt and a portion of the container are disengaged, thereby permitting removal of the cap. In yet another version of childproof closures, a cap must be rotated to a particular radial location with respect to the container. Provided the cap is kept at the predetermined radial location, axial movement of the cap with respect to the container will be permitted; this will be due either to the disengagement of interlocking components at the predetermined radial location, or because access to cap-gripping members will be provided at the predetermined radial location.

Although the prior container closures referred to are believed to adequately protect the container contents against access by a child, certain concerns exist above and beyond the achievement of their basic objective. One of the important concerns relates to the expense of manufacturing the cap. Generally speaking, it is moe difficult and expensive to manufacture container closures having threaded surfaces than it is to manufacture container closures without threaded surfaces. Many of the prior devices include threaded surfaces, and this feature means that the expense of the cap tends to be higher than desired. Yet other container closures sometimes are too difficult to use conveniently. That is, due to the actuating forces required or due to the required manipulation of small, difficult-to-grasp elements, even some adults have difficulty in moving the cap to a container-dispensing position. A related concept is that of "feel," or quality of cap movement. Childproof caps, if possible, should snap into a container-closing position, and should either snap to a container-open position or should move with a certain amount of drag to a container-open position. If the foregoing type of cap action is provided, the user will know when the container is closed or open merely by the feel and sound of the cap as it moves with respect to the container. Certain prior container closures have been deficient in the quality of cap movement.

SUMMARY OF THE INVENTION

The present invention overcomes the foregoing and other drawbacks of prior art proposals by providing a novel and improved childproof push-pull container closure having desirable qualities of manufacturing expense, ease of manipulation, and quality of cap movement. Interlocking cap components are shielded from view so that directions must be followed in order to open the container. Force must be applied to the cap in a first direction in order to disengage interlocking components, and force must thereafter be applied in a second direction to move the cap with respect to the container to a dispensing position.

In accordance with the preferred practice of the present invention, the container includes a body portion positioned at a discharge end of the container. The body portion includes an upper surface having an opening through which container contents may be discharged from the container. The body portion also includes a formation extending upwardly from its upper surface. In a preferred embodiment, the formation is in the form of a ledge. A pair of spaced, diametrically opposed flanges project radially outwardly from the ledge to define a pair of recesses located near the periphery of the body portion. A cap includes a top wall having a skirt depending from near the periphery of the top wall. Near the lower end of the skirt, an annular, radially inwardly directed flange is located. In a container-closed position, the annular flange is snapped into the recesses by the application of axial force to the top wall. In order to move the cap to a container-open position, radially inward force is applied to the skirt at circumferential locations spaced 90° from the recesses. The skirt is distorted to such an extent that the annular flange is moved out of the recesses, thereby freeing the cap for movement.

In a liquid-dispensing embodiment, the formation includes a ledge from which an upstanding portion extends. An inner skirt depends from the top wall, the inner skirt being located concentrically with respect to the outer skirt and closely surrounding the upstanding portion. The upstanding portion includes a radially outwardly directed annular flange, while the inner skirt includes a radially inwardly directed annular flange, the two flanges being located at different axial locations with respect to the container. The upstanding portion also includes a sealing surface against which a sealing means carried by the cap is seated. For example, the sealing means may include the inner diameter of an opening in the top wall, and the sealing surface may include a plug concentrically disposed with respect to the upstanding portion and extending a small distance beyond the end of the upstanding portion. The plug and the opening in the cap are the same size so that, upon movement of the cap axially of the container to a container-closed position, the opening and the plug tightly engage each other. Sealing also can be provided by a tight engagement between the outer surface of the upstanding portion and the inner surface of the inner skirt.

In a first embodiment for dispensing powders, the same general construction recited above is employed. In this embodiment, however, a plurality of small openings are provided in the end wall, the openings being arranged in a radial pattern. A relatively large opening is provided in the end wall at its center; a relatively long plug extends from the upstanding portion and through the center opening. An annular ring depends a short distance from the end wall, the annular ring being located raidally between the center opening and the smaller openings. The annular ring engages an end surface of the upstanding portion. Upon movement of the cap to a container-closed position, the annular ring engages the end surface of the upstanding portion to seal the container. Upon movement of the cap to a container-open position, powder can flow outwardly of the cap through the small openings. The plug and the center opening guide the cap for movement axially of the container.

In yet another embodiment for dispensing powders, the plug and the center opening are not provided. Rather, the annular ring is tapered on its outer surface and, in the container-closed position, extends downwardly into the upstanding portion a small distance and seats against the upper, inner end surface of the upstanding portion. In this embodiment, a number of small openings are provided at radial locations outwardly of the annular ring, but radially inwardly of a depending inner skirt. Upon movement of the cap to a container-open position, the annular ring is disengaged from the end of the upstanding portion and powder can flow outwardly of the cap through the small openings.

In a pill-dispensing embodiment, the formation includes the upstanding portion itself, and spaced, outwardly directed flanges are provided on the outer surface of the upstanding portion near its base. The top wall of the cap carries a sealing means, such as a ring of resilient material or a flexible lip, either of which bear against the upper end surface of the upstanding portion in the container-closed position. In this embodiment of the invention, a short depending inner skirt is provided, principally to guide the cap into proper position atop the container.

The foregoing and other features and advantages, and a fuller understanding of the invention, may be had be referring to the following description and claims, taken in conjunction with the accompanying drawings.

BRIEF DESCRIPTION OF THE DRAWINGS

FIG. 7 is a partly sectional view of another version of a pill-dispensing cap, in which a different type of sealing means is provided;

FIG. 8 is a view as seen from a plane indicated by line 8—8 in FIG. 5;

FIG. 9 is a view of the cap of FIGS. 5 or 7, in which the cap has been distorted by the application of user-applied forces to cause interlocking cap components to become disengaged;

FIG. 10 is a partly sectional view of a cap according to the invention particularly suited for dispensing powders;

FIG. 11 is a view similar to FIG. 10, showing the cap in a container-open position;

FIG. 12 is a sectional view as seen from a plane indicated by line 12—12 in FIG. 10;

FIG. 13 is a view similar to FIG. 12, showing the cap distorted under the influence of user-applied forces to cause interlocking cap components to become disengaged;

DESCRIPTION OF THE PREFERRED EMBODIMENT

Figure 1:
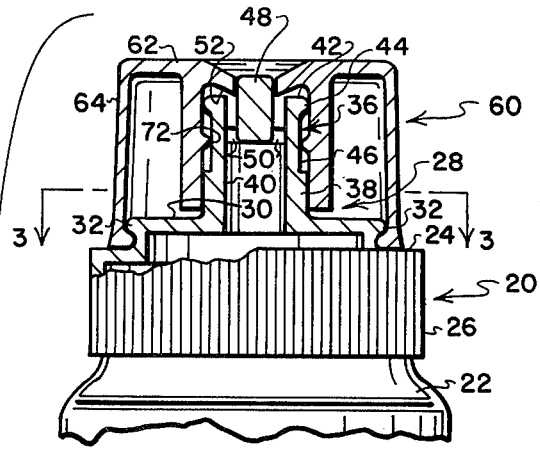
FIG. 1 is a partly sectional view of a cap according to the invention particularly suited for dispensing liquids.

Referring to FIGS. 1–4, a childproof, push-pull container closure particularly suited for dispensing liquids is indicated generally by the numeral 10. The invention also includes a pill-dispensing embodiment 100 (FIGS. 5–9), and two powder-dispensing embodiments 200 and 300 (FIGS. 10–17).

THE LIQUID-DISPENSING EMBODIMENT 10

Referring to FIGS. 1–4, the closure 10 includes a body portion 20 secured to a dispensing end of a container 22, as well as a cap 60 secured to the body portion 20. For ease of manufacture and to minimize expense, it is expected that the body portion 20 and the cap 60 will be manufactured entirely from a plastics material such as high density polyethylene or any other well known suitable plastics material. Desirably, the cap 60 will be relatively rigid, yet distortable under the influence of forces capable of being exerted by an adult. The cap 60 also is made preferably from polyethylene because its outer surface will be relatively friction-free, a factor which aids in preventing the cap 60 from being pulled axially from the body portion 20 merely through the use of excessive force.

The body portion 20 includes a flat upper surface 24 from which an outer skirt 26 depends. The upper surface 24 and the skirt 26 cooperate to engage a dispensing end of the container 22 in a leak-free manner. The body portion 20 can be attached to the container 22 by any number of known techniques such as spin welding, solvent welding, heat sealing, or even by the use of threads. Whatever attachment technique is used, it should be a locking attachment so that access to the container contents cannot be had by removing the body portion 20 from the container 22.

Figure 2:
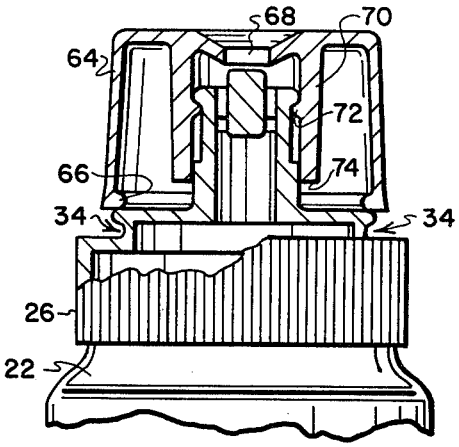
FIG. 2 is a view similar to FIG. 1, showing the cap in a container-open position.

The body portion 20 includes a formation 28 extending upwardly from the upper surface 24. The formation 28 includes a generally rectangular ledge 30 extending part way across the upper surface 24. The ledge 30 includes spaced, radially outwardly extending flanges 32. The flanges 32 are spaced 180° from each other. The diametric extent of the flanges 32 is less than the outer diameter of the upper surface 24 so that the flanges 32 do not extend beyond the periphery of the upper surface 24. The flanges 32 and the upper surface 24 cooperate to define recesses 34. Referring to FIGS. 1 and 2, the recesses 34 are rounded in cross-section, and referring to FIGS. 3 and 4, the flanges 32 are rounded when viewed from above. A pair of carets 35 are located near the periphery of the upper surface 24 and are spaced 90° circumferentially from the center of the flanges 32.

An upstanding portion 36 projects upwardly from the ledge 30. The upstanding portion 36 includes a cylindrical post 38 concentrically disposed with respect to the body portion 20. The post 38 includes an axially extending passage 40 opening at the lower end of the post 38 to communicate with the interior of the container 22. The passage 40 opens at the other end of the post 38 through an end surface 42 of the post 38. A radially outwardly directed annular flange 44 extends from the post 38 at its upper end. The post 38 also includes a circumferential recessed portion 46 connecting the flange 44 and extending axially of the post 38 to a location approximately mid-way along the length of the post 38. The outer diameter of the remainder of the post 38 is the same as that of the flange 44.

A cylindrical plug 48 is positioned concentrically within the opening 40 and is held in that position by radially extending legs 50. The legs 50 are spaced from each other so that container contents may pass outwardly of the container through the passage 40 between adjacent legs 50. The plug 48 includes an outer surface 52 which defines a sealing surface of the body portion 20.

The cap 60 includes a top wall 62 from which an outer skirt 64 depends. The skirt 64 extends from the top wall 62 at the outer diameter of the top wall 62 and is straight-sided in order to present a smooth outer surface to the user. A radially inwardly directed annular flange 66 extends from the skirt 64 at a point near the bottom of the skirt 64. The contour of the flange 66 is such that upon engagement of the body portion 20 and the cap 60 as shown in FIG. 1, the flange 66 will be snapped into tight engagement with the recesses 34. The axial length of the skirt 64 is such that the bottom of the skirt engages the upper surface 24 when the cap 60 is in the container-closed position of FIG. 1. Accordingly, only a smooth outer surface is presented to the user and interlocking cap components are concealed.

The top wall 62 includes an opening 68 located at the center of the top wall 62. An inner skirt 70 depends from the top wall 62 and surrounds the opening 68. The inner skirt 70 includes a radially inwardly directed annular flange 72. The flange 72 is located approximately mid-way along the length of the skirt 70 and has an inner diameter approximately equal to the outer diameter of the circumferential recess 46. The axial length of the skirt 70 is such that its lower end surface 74 clears the upper surface of the ledge 30 when the body portion 20 and the cap 60 are in the container-closed position illustrated in FIG. 1. The inner diameter of the opening 68 is the same as, or slightly smaller than, the outer diameter of the plug 48.

OPERATION OF THE LIQUID-DISPENSING EMBODIMENT

Figure 3:
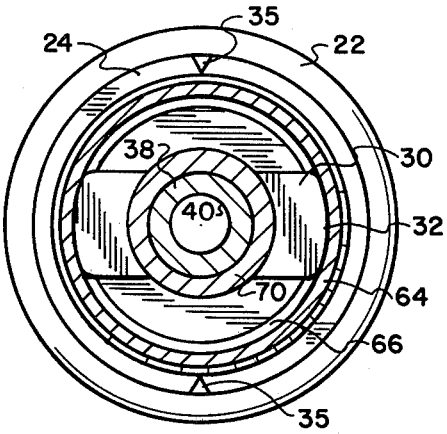
FIG. 3 is a sectional view as seen from a plane indicated by line 3—3 in FIG. 1.
Figure 4:
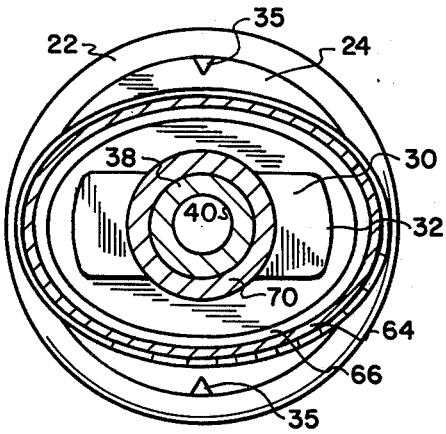
FIG. 4 is a view similar to FIG. 3, in which the cap has been distorted by the application of forces to cause interlocking components to be disengaged.

Referring particularly to FIGS. 3 and 4, it will be assumed that the cap 60 is in the container-closed position of FIG. 1. When it is desired to move the cap 60 to a container-open position, force is applied to the lower portion of the skirt 64 at those points indicated by the carets 35. If enough force is applied, the skirt 64 will be distorted to that position shown in FIG. 4. The annular flange 66 will be moved out of the recesses 34 and, upon the application of axial force to the cap 60, the cap 60 will be moved to that position shown in FIG. 2. In this position, a gap is created between the inner diameter of the opening 68 and the outer surface 52 of the plug 48. Accordingly, container contents can be discharged. Axial movement of the cap 60 with respect to the body portion 20 is limited by engagement between the flanges 44, 72.

In order to seal the container 22, force is applied to the top wall 62 to move the cap 60 to that position shown in FIG. 1. The cap 60 is retained in this position by engagement between the flange 66 and the recesses 34. Sealing of container contents is effected by engagement between the inner diameter of the opening 68 and the outer surface 52 of the plug 48. Additional sealing is created by engagement between the flange 44 and the inner diameter of the skirt 70. Yet additional sealing is created by engagement between the flange 72 and the recess 46, as well as engagement between the lower portion of the post 38 and the inner diameter of the skirt 70. The quality of cap movement is excellent because the cap 60 snaps into the container-closed position and moves with the proper amount of drag to the container-open position.

THE PILL-DISPENSING EMBODIMENT 100

Referring to FIGS. 5–9, an embodiment 100 especially adapted for dispensing pills is shown. Many of the components of this, and later embodiments, are the same as those described already. Accordingly, where the same reference numerals are used, they refer to parts or features identical to those described already. Where reference numerals having the same last two digits as those used previously are used, they refer to parts or features which correspond to, but which are somewhat differently configured than, those described previously. Where entirely new reference numerals are used, they refer to entirely new parts or features.

A formation 128 is different from the formation 28 in that the ledge 30 is not provided, but rather an upstanding portion 136 includes a modified post 138 of enlarged diameter compared with the post 38. Flanges 132 extend radially outwardly of the post 138 near a lower region of the post 138. Viewed from above (FIG. 6), the post 138 is oblong and includes straight sides 139; the flanges 132 subtend a greater arc than do the flanges 32. The post 138 includes an upper end surface 142.

A cap 160 generally is like that used with the liquid-dispensing embodiment 10, except that the opening 68 is not provided in a top wall 162 and a modified inner skirt 170 is provided. The inner skirt 170 is circular when viewed from the end and includes a beveled outer end surface 171. The outer diameter of the inner skirt 170 is approximately equal to the distance separating the inner surfaces of the sides 139.

A sealing means also is provided for the cap 160. The sealing means includes a flexible lip 173 extending radially inwardly toward the center of the cap 60 from a point near the juncture of the top wall 162 and the skirt 64. If desired, an alternate sealing means can be provided. Referring to FIG. 7, the lip 173 is not used, and, in its place, a resilient ring 175 is provided. The ring 175 may be made of plastisol or any other well known plastics sealing material.

OPERATION OF THE PILL-DISPENSING EMBODIMENT 100

Figure 5:
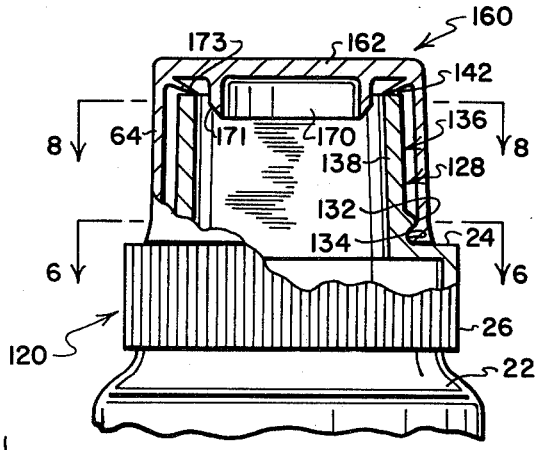
FIG. 5 is a partly sectional view of another cap according to the invention particularly suited for dispensing pills.
Figure 6:
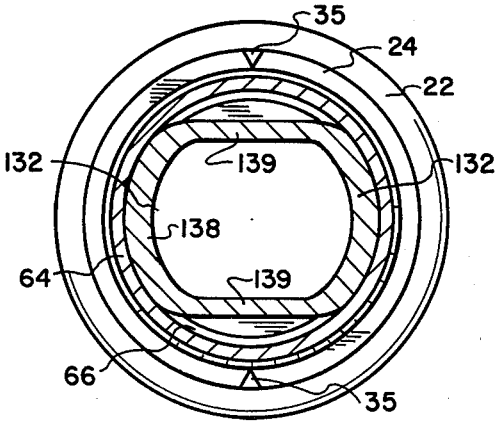
FIG. 6 is a sectional view as seen from a plane indicated by line 6—6 in FIG. 5.

It will be assumed that the cap 60 is in the container-closed position of FIGS. 5 and 7. In this position, either the lip 173 or the ring 175 will be compressed against the upper end surface 142 to tightly seal the container 22. When it is desired to dispense pills from the container 22, force is applied to the lower portion of the outer skirt 64 at locations indicated by the carets 35, and the skirt 64 will be distorted to that position shown in FIG. 9. The flanges 66, 132 will be disengaged and the cap 160 can be removed entirely from body portion 120. The cap 160 can be sealed atop the body portion 120 by applying force to the end wall 162, and the flange 66 will be snapped into the recesses 134.

THE POWDER-DISPENSING EMBODIMENTS 200, 300

1. The Center Plug Version 200

Referring particularly to FIGS. 10–13, a modified body portion 220 includes a post 238 having a greater diameter than the post 38 of the liquid-dispensing embodiment and a plug 248 which projects considerably beyond a conical end surface 242 of the post 238. Also, legs 250 are inclined upwardly. Otherwise, the body portion 220 essentially is the same as the body portion 20 of the liquid-dispensing embodiment.

A modified cap 260 includes a concave top wall 262 having a large opening 268 located at its center. A number of smaller openings 279 are located radially outwardly of the opening 268. A sealing means also is provided for the cap 260, and includes a depending ring 281 having a conical end surface 283 engageable with the conical end surface 242 of the post 238. The ring 281 is located at a radial location intermediate the central opening 268 and the smaller openings 279.

2. The Plugless Version 300

Referring particularly to FIGS. 14–17, a version 300 of the powder-dispensing embodiment not requiring the use of a plug 248 is shown. In this version, the end surface of the post 338 does not include a conical end surface 242, but rather includes a flat end surface 342. In order to break up lumps in the powder being dispensed, a spider 383 is positioned within the passage 340.

A modified cap 360 includes a generally flat top wall 362 from which a concentric ring 381 having a tapered outer surface 383 depends. The outer surface 383 includes a portion having a diameter equal to that of the passage 340. A plurality of small openings 379 are located radially outwardly of the ring 381, but radially inwardly of a depending inner skirt 370.

OPERATION OF THE POWDER-DESPENSING EMBODIMENTS 200, 300

The two powder-dispensing embodiments 200, 300 operate substantially identically. As in the previously described embodiments, the caps 260, 360 are moved from a container-closing position relative to the body portion 220, 320 by applying force to the skirt 64 at indicated locations. The resultant distortion of the skirt 64 causes the flange 66 to be moved out of the recesses 234, 334 and the cap 260, 360 is freed for axial movement relative to the body portion, 220, 320.

In the version of FIGS. 10–13, the plug 248 keeps the cap 260 centered with respect to the post 238 during axial movement of the cap 260. The plug 248 and the opening 268 always are engaged with each other. Separation of the end surfaces 242, 283 creates an opening through which powder may pass to the openings 279.

Figures 14, 15, 16, 17:
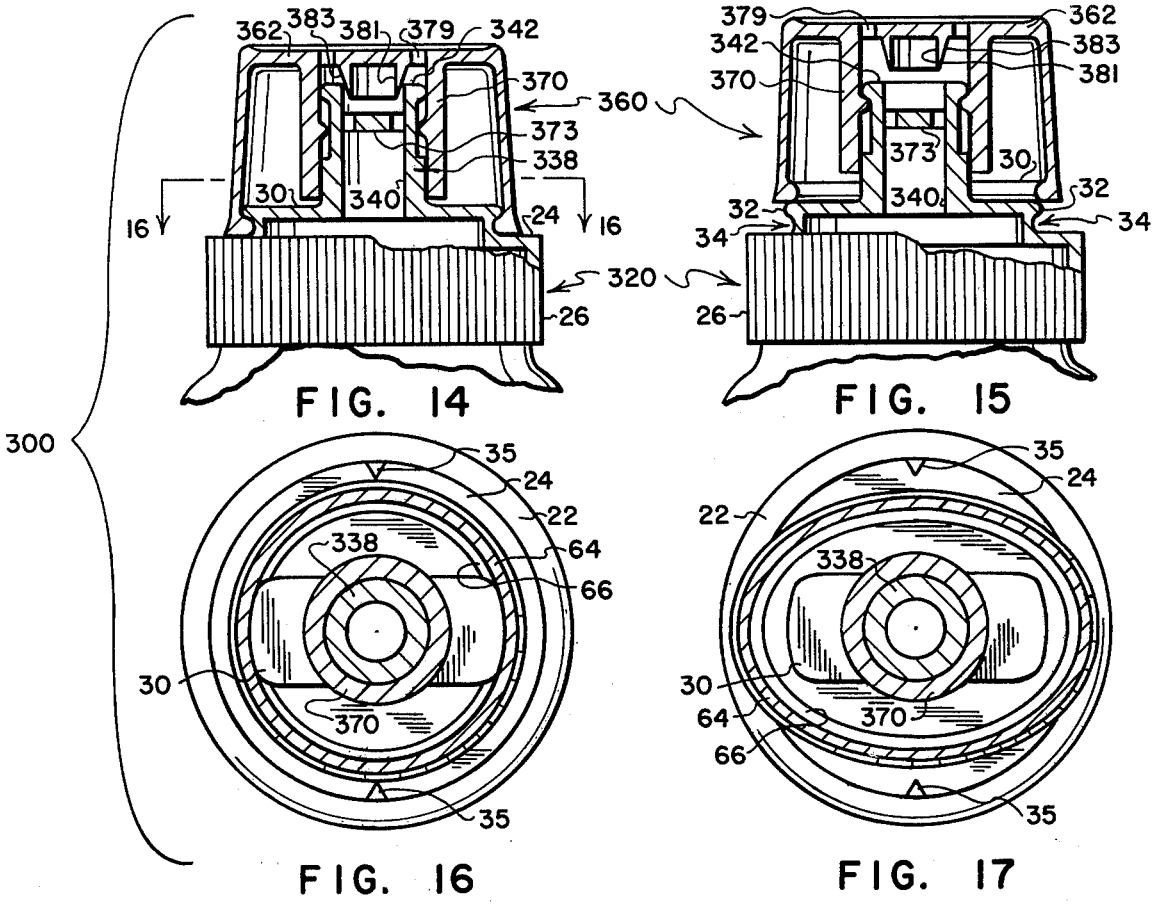
FIG. 14 is a partly sectional view of another cap according to the invention particularly suited for dispensing powders.
FIG. 15 is a view similar to FIG. 14, showing the cap in a container-open position.
FIG. 16 is a sectional view as seen from a plane indicated by line 16—16 in FIG. 14.
FIG. 17 is a view similar to FIG. 16 showing the cap distorted under the influence of user-applied forces to cause interlocking cap components to become disengaged.

In the version of FIGS. 14–17, axial displacement of the cap 360 to that position shown in FIG. 15 causes the tapered outer surface 383 to be separated from the end of the post 338. Powder may pass outwardly of the container 22 through the opening thus created and through the openings 379.

It will be appreciated from the foregoing description that a childproof container closure according to the invention is exceedingly simple and strong. It can be manufactured inexpensively entirely from plastics materials without the need for employing threaded surfaces of any kind. The cap shields internally disposed interlocking components so that a user must be able to know where to apply force to the cap in order to permit the cap to be moved to a container-open position. The shapes of the outer surface of the cap is such that children cannot grasp it easily, and the slippery nature of the cap makes it even more difficult for children to displace the cap. The interaction among the various components produces a good quality of cap movement upon opening or closing the container.

Although the invention has been described in its preferred form with a certain degree of particularity, it will be understood that the present disclosure of the preferred form has been made only by way of example and that numerous changes in the details of construction and the combination and arrangement of parts may be resorted to without departing from the true spirit and scope of the invention as hereinafter claimed. Merely by way of example and not by way of limitation, it would be possible to interchange the position of interlocking components of the invention and still perform the same function; this type of variant clearly is within the scope of the invention. It is intended that the patent shall cover, by suitable expression in the appended claims, whatever features of patentable novelty exist in the invention disclosed.

What is claimed is:

1. A protective closure for a container, the closure including a cap adapted to be displaced relative to the container to selectively permit or prevent the discharge of container contents from the container, cap displacement being permitted only in response to a deliberate distortion of the cap under the influence of forces greater than that which a child is capable of generating and/or in response to a sequence of cap movements which a child cannot accomplish, comprising:

(a) a body portion extending from the container, the body portion having an opening through which container contents may be discharged from the container;

(b) a protective cap, the cap adapted to be secured to the body portion to seal the opening in the body portion when so secured, the cap including a top wall and a skirt depending from the top wall, at the periphery of the top wall, the cap being movable with respect to the body portion;

(c) connecting means included as part of the body portion and the cap for permitting movement of the cap into and out of a sealing position atop the body portion, the connecting means being shielded from view by the cap, the connecting means including:

(i) a first locking portion carried by the body portion, the first locking portion extending from the body portion toward the skirt when the cap is in a container-closed position, the first locking portion including spaced recesses located near the periphery of the body portion, the recesses being radially outwardly directed; and, (ii) a second locking portion included as part of the cap, the second locking portion being located near the lower inner periphery of the skirt and including an annular, radially inwardly directed flange, the flange having a diametric extent such that a mechanical, interlocking fit with the recesses exists when the cap is in a container-closed position atop the body portion and the skirt must be acted upon in a deliberate manner to move the flange and recesses out of engagement with each other; and, (d) the cap is formed of a relatively rigid, relatively friction-free material, the skirt being distortable under the influence of radially inwardly directed forces applied to the skirt at locations spaced 180 degrees from each other, whereby the flange will be moved outwardly with respect to the recesses to disengage the flange and recesses and thereby permit displacement of the cap to a container-open position.

2. The container closure of claim 1, further comprising:

(a) an upstanding portion included as part of the body portion, the upstanding portion including a passage through which container contents are discharged;

(b) a formation located near the base of the upstanding portion, the formation defining the first locking portion; and, (c) an inner skirt depending from the top wall, the inner skirt being positioned concentrically with respect to the outer skirt, the inner skirt engaging the upstanding portion to assist in sealing container contents and to assist in guiding the cap into a container-closed position atop the body portion.

3. The container closure of claim 2, further comprising sealing means carried by the cap, the sealing means engageable with the upstanding portion to provide a leak-free container closure upon engagement between the first and second locking portions.

4. The container closure of claim 3, wherein the sealing means includes a layer of resilient material engageable with an end surface of the upstanding portion, the resilient material being compressed with the cap is secured to the body portion in a container-closed position.

5. The container closure of claim 3, wherein the sealing means includes a flexible, circumferential lip extending radially inwardly, the lip being engageable with an end surface of the upstanding portion, the lip being flexed when the cap and the body portion are in a container-closed position.

6. The container closure of claim 2, wherein:

(a) the upstanding portion includes a radially outwardly directed first annular flange proximate its upper end, the upper end of the upstanding portion also defining at least a portion of a sealing surface;

(b) the inner skirt has an inner diameter approximately equal to the outer diameter of the annular flange;

(c) the inner skirt includes a radially inwardly directed second annular flange, the second annular flange being located axially of the inner skirt at a position closer to the container than the first annular flange;

(d) a sealing means carried by the cap, the sealing means engageable with the sealing surface to effect a container-contents-tight seal; and (e) an opening in the cap, the opening being in communication with the opening in the upstanding portion when the cap is in a container-open position, the opening in the cap being isolated from the opening in the upstanding portion when the sealing means engages the sealing surface.

7. The container closure of claim 6, wherein:

(a) the upstanding portion includes a plug concentrically disposed within the passage and located near the end of the passage, the outer surface of the plug defining a portion of the sealing surface; and (b) the opening in the cap is tightly engageable with the plug when the cap is in the container-closed position, the opening in the cap thus defining at least a portion of the sealing means.

8. The container closure of claim 7, wherein the sealing means carried by the cap includes an annular ring projecting downwardly from the top wall, the ring being disposed within the inner skirt and engageable with the upstanding portion.

9. The container closure of claim 8, wherein the annular ring is tapered on its outer surface and fits within the end of the passage in the upstanding portion.

10. The container closure of claim 8, wherein:

(a) the plug is of such a length that the plug and the opening in the cap always are mated; and (b) a plurality of openings are located in the top wall at a radial location intermediate the plug and the inner skirt.

11. A container closure for dispensing liquids, powders, pills and the like from a container, the closure being opened to permit removal of container contents only in response to a deliberate distortion of the closure under the influence of forces greater than that which a child is capable of exerting and/or in response to a sequence of movements which a child cannot accomplish, comprising:

(a) a body portion extending from the container, the body portion having an opening through which contents of the container may pass outwardly of the container;

(b) a formation carried by the upper surface of the body portion, the formation including a ledge which when viewed from above is generally rectangular and has a diametric extent less than that of the body portion, the ledge including an opening in communication with the opening in the body portion;

(c) a recess facing radially outwardly from each end of the ledge toward the outer surface of the body portion, the recesses being spaced above the upper surface of the body portion;

(d) an upstanding portion extending upwardly from the upper surface of the ledge, the upstanding portion having a longitudinally extending passage in communication with the opening in the ledge, the passage in the upstanding portion opening through the upper end surface of the upstanding portion;

(e) a sealing surface defined at least in part by the upstanding portion at or near the upper end of the upstanding portion; and (f) a cap engageable with the body portion to effect a container-closing function, the cap including:

(i) a top wall, the top wall having an opening in communication with the opening in the upstanding portion, whereby container contents can be discharged from the container;

(ii) an outer skirt depending from the top wall, the skirt having a lower end surface located adjacent the upper surface of the body portion;

(iii) a radially inwardly directed annular flange extending from the inner surface of the outer skirt, the flange being located proximate the end surface of the outer skirt, the inner diameter of the annular flange being approximately equal to the inner diameter of the recesses;

(iv) a sealing means included as part of the top wall, the sealing means engageable with the sealing surface included as part of the upstanding portion, the sealing means engageable with the sealing surface when the cap is in a container-closed position to prevent discharge of container contents from the passage in the upstanding portion, the sealing means being disengageable from the sealing surface when the cap is in a container-opened position to permit discharge of container contents through the passage in the upstanding portion and the opening in the top wall; and, (v) the outer skirt being sufficiently flexible that under the influence of forces applied at opposed circumferential locations spaced 90° from the recesses, the annular flange is displaced radially outwardly relative to the recesses, whereby disengagement between the annular flange and the recesses is effected and axial movement of the cap relative to the body portion is made possible.

12. The container closure of claim 11, wherein:

(a) the sealing surface includes a longitudinally extending plug disposed concentrically within the passage in the upstanding portion, the plug being located at or near the end surface of the upstanding portion; and, (b) the sealing means is defined in part by the inner diameter of the opening in the top wall, the inner diameter of the opening being equal to the outer diameter of the plug.

13. The container closure of claim 11, wherein:

(a) the sealing surface is defined at least in part by the inner diameter of the passage in the upstanding portion; and, (b) the sealing means includes a ring extending vertically downwardly from the center of the top wall, the ring having an outer diameter approximately equal to the inner diameter of the passage in the upstanding portion, the opening in the top wall being located radially outwardly of the ring.

14. The container closure of claim 11, further comprising an inner skirt depending from the top wall, the inner skirt extending toward the body portion and being spaced from the ledge when the cap is in the container-closed position, the inner skirt having an inner diameter equal to or greater than the outer diameter of the upstanding portion.

15. The container closure of claim 14, wherein:

(a) a first annular flange extends radially outwardly of the upstanding portion, the annular flange being located at or near the upper end of the upstanding portion; and, (b) a radially inwardly directed second annular flange extends from the inner surface of the inner skirt, the second annular flange being located closer to the ledge than the first annular flange, whereby axial movement of the cap relative to the body portion is limited by engagement between the first and second annular flanges.

16. The container closure of claim 11, additionally comprising indicator means for indicating to a user where forces should be applied to the outer skirt in order to displace the annular flange from the recesses, the indicator means being included as part of a portion of the container closure stationary with respect to the recesses, the indicator means being visible when the cap is in the container-closed position.

17. The container closure of claim 16, wherein the indicator means comprises a caret carried by the body portion and located at a circumferential location spaced 90° from the midpoint of the recesses.

18. A container closure primarily for dispensing liquds from a container, the closure being opened to permit removal of container contents only in response to a deliberate distortion of the closure under the influence of forces greater than that which a child is capable of exerting and/or in response to a sequence of movements which a child cannot accomplish, comprising:

(a) a body portion secured to a discharge end of the container, the body portion having an opening through which contents of the container may pass outwardly of the container, the body portion having a generally flat upper surface;

(b) a formation carried by the upper surface of the body portion, the formation including a ledge which when viewed from above is generally rectangular and has a diametric extent less than that of the body portion, the ledge including an opening in communication with the opening of the body portion:

(c) a flange facing radially outwardly from the upper portion of each end of the ledge, the flanges facing toward the periphery of the body portion and being spaced above the upper surface of the body portion to define recesses intermediate the underside of the flanges and the upper surface of the body portion;

(d) indicators carried by the body portion, the indicators including diametrically opposed markers located circumferentially of the body portion at a point 9° between the recesses near the periphery of the body portion;

(e) a cylindrical upstanding portion extending upwardly from the upper surface of the ledge, the upstanding portion having a longitudinally extending passage in communication with the opening in the ledge, the passage in the upstanding portion opening through the upper end surface of the upstanding portion;

(f) a sealing surface defined at least in part by the upstanding portion at or near the upper end of the upstanding portion, the sealing surface also including a portion of the sides of the upstanding portion; and, (g) a cap engageable with the body portion to effect a container-closing function, the cap including:

(i) a generally flat top wall, the top wall having an opening in communication with the opening in the upstanding portion, whereby container contents can be discharged from the container;

(ii) a straight-sided outer skirt depending from the top wall, the skirt having a lower end surface located adjacent the upper surface of the body portion, the skirt being connected to the top wall at the periphery of the top wall to present a substantially smooth, indentation-free exterior surface;

(iii) a radially inwardly directed annular flange extending from the inner surface of the outer skirt, the flange being located proximate the end surface of the inner skirt, the inner diameter of the annular flange being approximately equal to the inner diameter of the recesses, the spacing of the flange from the end surface of the outer skirt being such that the flange engages the recesses when the end surface of the outer skirt engages the upper surface of the body portion;

(iv) a longitudinally extending plug disposed within the passage in the upstanding portion, the plug being located at or near the end surface of the upstanding portion and projecting beyond the end surface of the upstanding portion, the plug being tightly engaged with the opening in the top wall when the cap is in the container-closed position, the plug being disengaged from the opening in the top wall when the cap is in the container-open position;

(v) an inner skirt depending from the top wall, the inner skirt extending toward the body portion and being spaced from the ledge when the cap is in the container-closed position, the inner skirt having an inner diameter equal to or greater than the outer diameter of the upstanding portion and engageable with the upstanding portion under all conditions of use;

(vi) A first annular flange extending radially outwardly of the upstanding portion, the first annular flange being located at or near the upper end of the upstanding portion, the first annular flange being in contact with the inner surface of the inner skirt;

(vii) a circumferential recess included as part of the upstanding portion, the recess being located intermediate the first annular flange and the upper surface of the ledge;

(viii) a radially inwardly directed second annular flange extending from the inner surface of the inner skirt, the second annular flange being positioned in the circumferential recess, the first and second annular flanges being of a diameter such that axial movement of the cap relative to the body portion in a direction away from the ledge results in interference between the first and second annular flanges, whereby axial movement of the cap relative to the body portion is limited; and, (ix) the outer skirt being sufficiently flexible that under the influence of forces applied at locations indicated by the markers, the annular flange is displaced radially outwardly relative to the recesses, whereby disengagement between the annular flange and the recesses is effected and axial movement of the cap relative to the body portion is made possible.

* * * * *